US008308324B2

(12) United States Patent
Van Horn et al.

(10) Patent No.: US 8,308,324 B2
(45) Date of Patent: Nov. 13, 2012

(54) HIGH BAY LIGHT

(75) Inventors: John D. Van Horn, Bedford, TX (US); Richard I. Grant, Jr., Irving, TX (US); Christopher M. LePage, Richland Hills, TX (US)

(73) Assignee: Genessee Stamping and Fabricating, Inc., Grand Prairie, TX (US)

( * ) Notice: Subject to any disclaimer, the term of this patent is extended or adjusted under 35 U.S.C. 154(b) by 375 days.

(21) Appl. No.: 12/800,834

(22) Filed: May 24, 2010

(65) Prior Publication Data

US 2011/0286226 A1 Nov. 24, 2011

(51) Int. Cl.
*F21S 8/00* (2006.01)

(52) U.S. Cl. ..... 362/427

(58) Field of Classification Search ..... 362/427
See application file for complete search history.

(56) References Cited

U.S. PATENT DOCUMENTS

| | | | | |
|---|---|---|---|---|
| 6,450,668 | B1 * | 9/2002 | Kotloff | 362/269 |
| 2007/0283655 | A1 * | 12/2007 | Tobin | 52/478 |
| 2010/0296287 | A1 * | 11/2010 | Huang | 362/249.02 |
| 2011/0090707 | A1 * | 4/2011 | Chiang | 362/427 |

* cited by examiner

*Primary Examiner* — Anh Mai
*Assistant Examiner* — Andrew Coughlin
(74) *Attorney, Agent, or Firm* — Dennis L. Thomte; Thomte Patent Law Office LLC

(57) ABSTRACT

A high bay light including a mounting plate which may be secured to either a vertically disposed support or a horizontally disposed support. One to four LED light modules are secured to the mounting plate and are mounted thereon in such a way to achieve various lighting patterns.

12 Claims, 12 Drawing Sheets

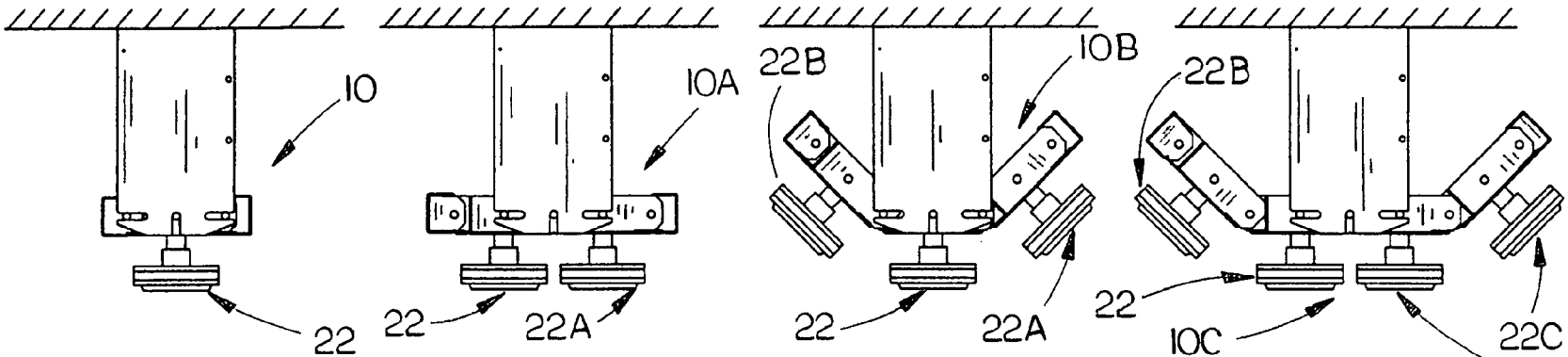
FIG. 18
FIG. 19
FIG. 20
FIG. 21
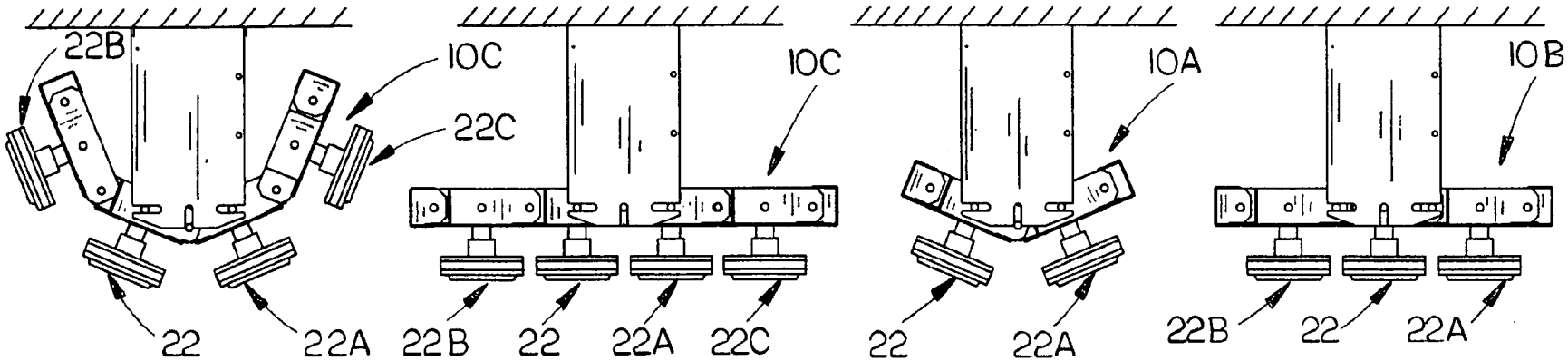
FIG. 22
FIG. 23
FIG. 24
FIG. 25

HIGH BAY LIGHT

BACKGROUND OF THE INVENTION

1. Field of the Invention

This invention relates to a high bay light or shop light and more particularly to a high bay light including one to four LED modules mounted on a mounting plate which is supported on a vertically disposed support surface or a horizontally disposed support surface. Even more particularly, this invention relates to a high bay light wherein the LED modules may be pivotally moved with respect to one another to achieve different lighting effects.

2. Description of the Related Art

Many types light fixtures have been previously provided for supporting one or more mercury vapor, incandescent or florescent lights above a bay area. Recently, LED light fixtures have replaced the lights identified above for several reasons. First, mercury vapor lights consume considerable power and require some time to fully gain power once they have been turned on. Incandescent lights give off considerable heat. Florescent lights like the other enumerated lights require frequent replacement.

LED lights are useful as bay lights due to lower power consumption and longevity. A problem exists with LED lights is that the fixtures thereof are not readily adjustable to illuminate different areas of the bay. Further, the further prior art LED fixtures are difficult to fabricate and require a large number of component parts.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A high bay light is disclosed which includes a mounting plate including a generally flat base portion having first and second spaced-apart leg portions extending transversely therefrom. The base portion of the mounting plate may be attached to either a vertically disposed support or a horizontally disposed support. Between one and four LED module brackets are adjustably mounted on the mounting plate with each of the module brackets having an LED module positioned thereon. If a single LED module bracket and LED module is affixed to the mounting plate, the bracket and module is not adjustable with respect to the mounting plate. If two LED module brackets with LED modules mounted thereon are utilized, the two LED module brackets may either be mounted on the mounting plate parallel to one another or angularly disposed with respect to one another. If three LED module brackets with LED modules are utilized, the three LED module brackets may be aligned in a side-to-side relationship with respect to one another or the two outermost LED module brackets may be angularly disposed with respect to the central LED module bracket. If four LED module brackets with LED modules are utilized, the four LED module brackets may be aligned in a side-to-side relationship or angularly disposed with respect to one another. Means is provided for limiting the pivotal movement of the LED module brackets with respect to one another.

If a single LED module bracket is utilized, end caps are placed on the ends of the LED module bracket. If two LED module brackets are utilized, end caps are placed on the outer ends of the first and second LED module brackets. If three or four LED module brackets are utilized, end caps are placed on the ends of the first and fourth LED module brackets.

It is therefore a principal object of the invention to provide an improved high bay light.

A further object of the invention is to provide a high bay light including one to four LED module bracket modules affixed to a mounting plate which may be secured to either a vertically disposed support surface or a horizontally disposed support surface.

A further object of the invention is to provide a high bay light which is comprised of a minimum number of component parts since many of the component parts are identical to one another.

A further object of the invention is to provide a high bay light which is easy to fabricate and easy to assemble.

A further object of the invention is to provide a high bay light comprised of a plurality of LED light modules which may be either positioned in a side-to-side relationship or angularly disposed with respect to one another.

A further object of the invention is to provide a high bay light including LED module brackets which have cooling slots or openings formed therein which also reduces dust accumulation thereon.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 18 is a side view of the invention utilizing a single LED module;

FIG. 19 is a view similar to FIG. 18 except that a pair of LED modules are utilized in a side-to-side manner;

FIG. 20 is a view similar to FIGS. 18 and 19 except that three LED modules are utilized with the modules being illustrated in an angularly disposed relationship with respect to one another;

FIG. 21 is a view similar to FIGS. 18, 19 and 20 except that four LED module brackets with LED modules thereon are secured to the mounting plate;

FIG. 22 is a view similar to FIG. 21 except that the two middle LED module brackets have been angularly disposed with respect to the mounting plate;

FIG. 23 is a view similar to FIG. 22 except that the four LED module brackets are aligned in a side-to-side relationship;

FIG. 24 is a view similar to FIG. 19 except that the LED module brackets are disposed at an angle with respect to one another; and FIG. 25 is a view similar to FIG. 3 except that the LED module brackets are disposed in a side-to-side relationship with respect to one another.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 11:
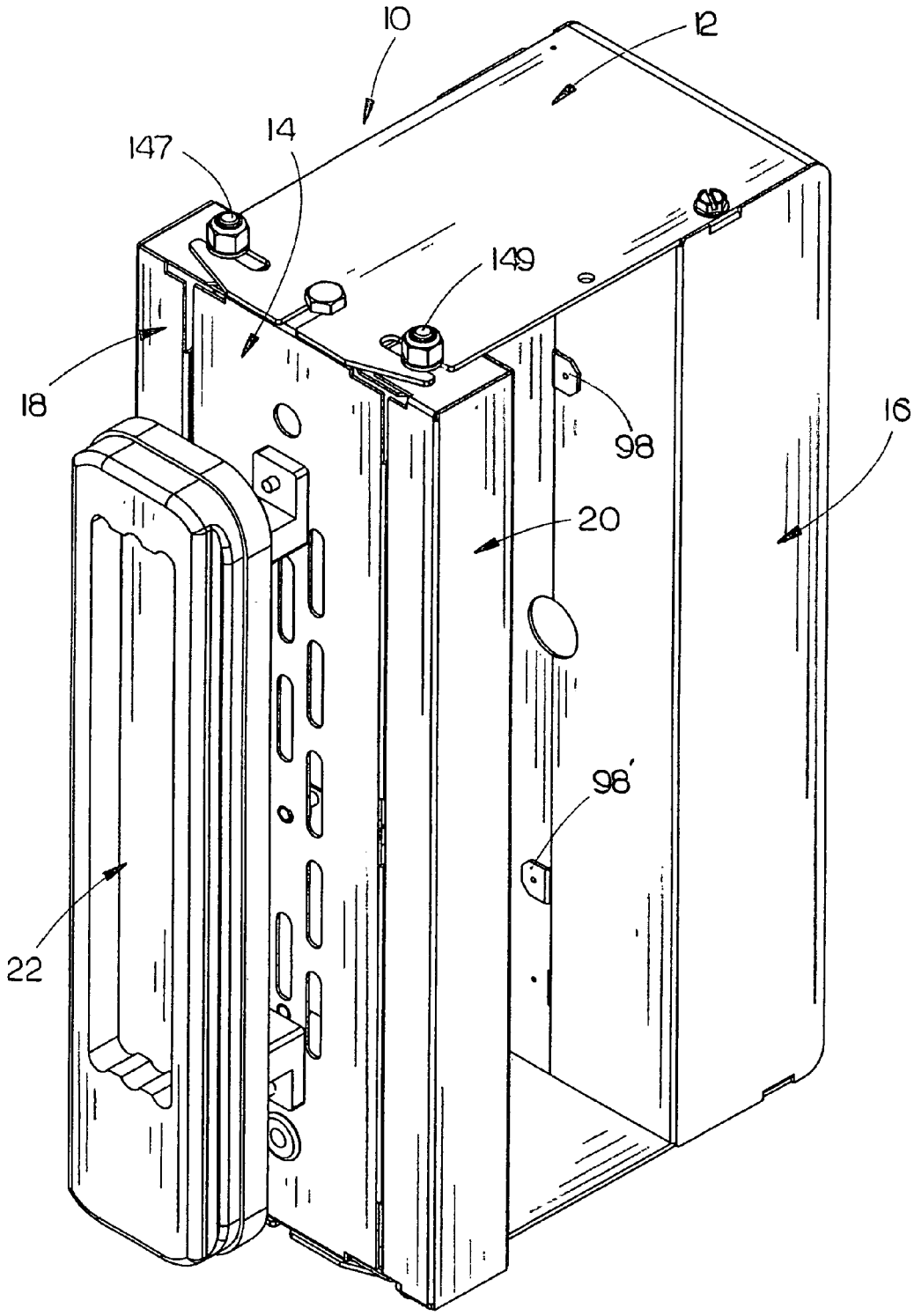
FIG. 11 is a perspective view illustrating the LED module, LED module bracket with end caps thereon mounted on the mounting plate of this invention.

The high bay light of this invention is referred to by the reference numeral 10 in FIG. 11 which includes a mounting plate 12, an LED module bracket 14, junction box cover 16, a pair of end caps 18 and 20, and LED module 22. LED module 22 is of conventional design and is readily available. LED module 22 includes an LED engine panel. The high bay light 10 may be mounted on a horizontally disposed support such as a ceiling or rafter and may also be mounted on a vertically disposed support such as a wall. FIGS. 18-25 illustrate various configurations of the light 10 being suspended from a ceiling. For ease of description, the light 10 and the components thereof are illustrated in the drawings as being oriented so as to be mounted on a vertically disposed support with the light 10 having upper and lower ends.

Figure 15:
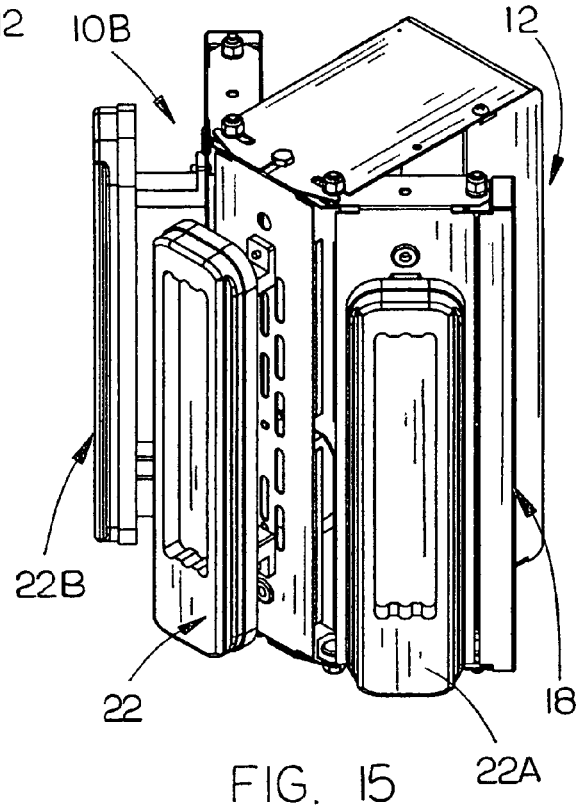
FIG. 15 is a perspective view illustrating the invention wherein three LED module brackets with LED modules thereon are mounted on the mounting plate.
Figure 16:
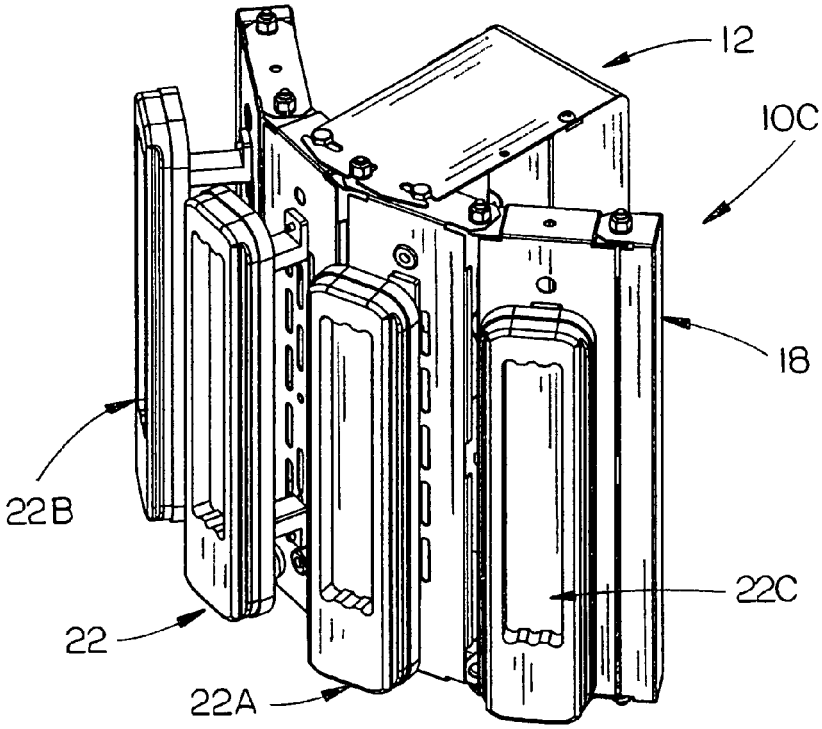
FIG. 16 is a perspective view illustrating four LED module brackets with LED modules mounted thereon secured to the mounting plate of this invention.
Figure 17:
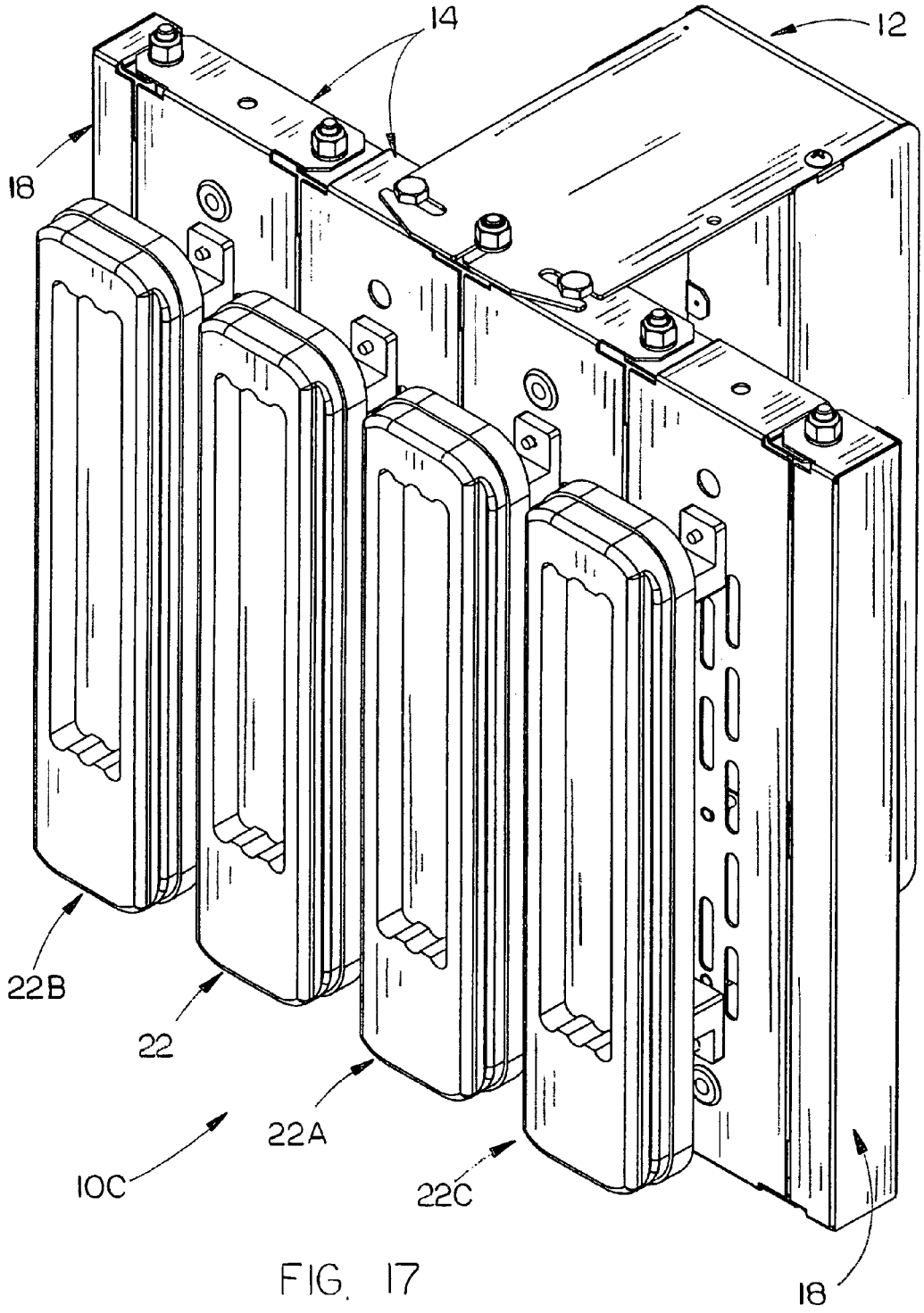
FIG. 17 is a perspective view similar to FIG. 16 except that the four LED module brackets with LED modules thereon are aligned in a side-to-side manner.

FIGS. 11 and 18 illustrate a light 10 wherein only a single LED module 22 is utilized. In FIGS. 19 and 24, the light 10A includes two LED modules 22 and 22A. In FIGS. 15, 20 and 25, the light 10B includes three LED modules 22, 22A and 22B. In FIGS. 16, 21, 22 and 23, the light 10C includes four LED modules 22, 22A, 22B and 22C. Lights 10A, 10B and 10C include all of the structure of light 10 except that the end caps 18 and 20 are only used on the ends of the outermost LED module brackets as will be explained hereinafter.

Figure 1:
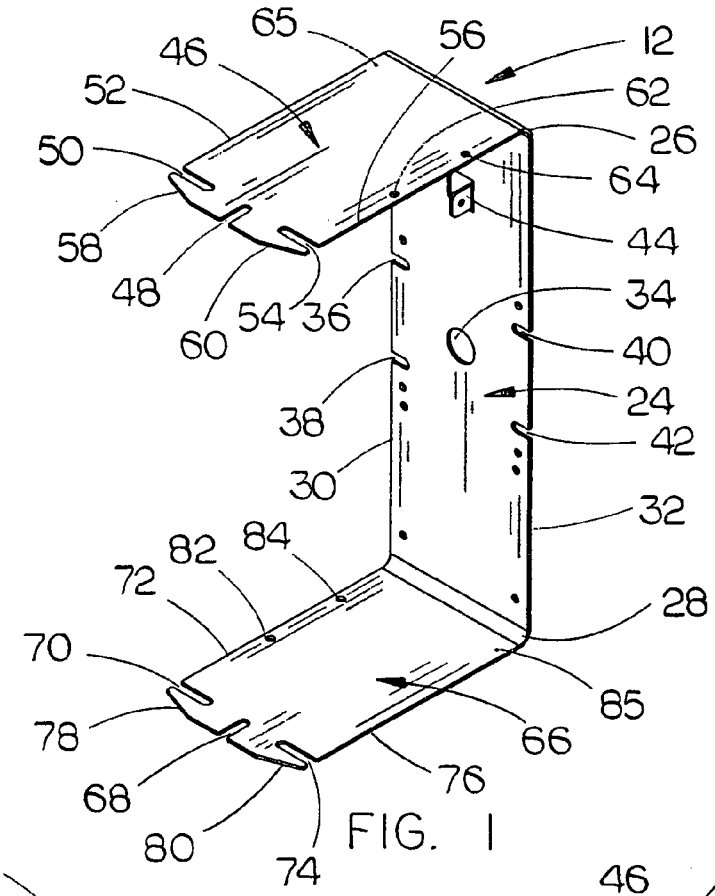
FIG. 1 is a perspective view of the mounting plate portion of this invention.
Figure 2:
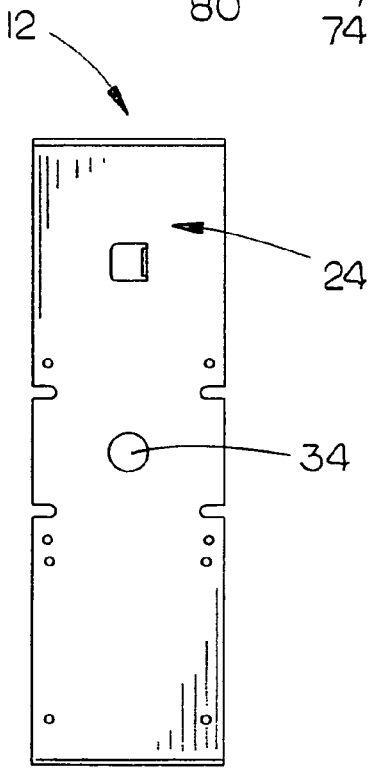
FIG. 2 is a front view of the mounting plate of FIG. 1.
Figure 3:
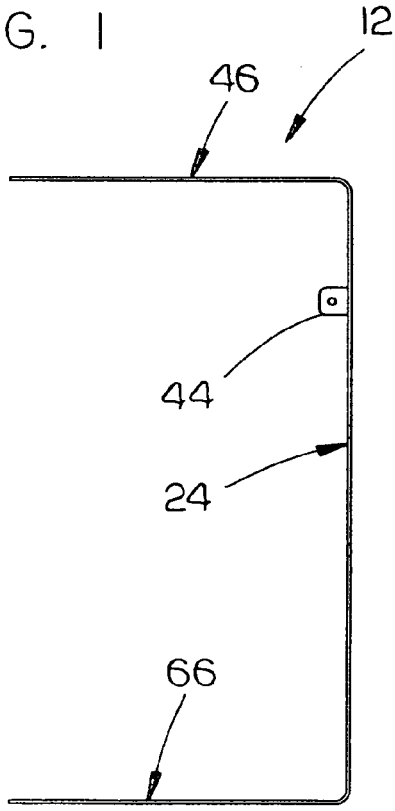
FIG. 3 is a side view of the mounting plate of FIG. 1.

Mounting plate 12 includes a generally flat base portion 24 having an upper end 26, lower end 28, and side edges 30 and 32. A central opening 34 is provided in base portion 24 to permit electrical leads or wires to be extended therethrough. Side edge 30 has a pair of U-shaped notches 36 and 38 formed therein (FIG. 1). Side edge 32 has a pair of U-shaped notches 40 and 42 formed therein (FIG. 1). Ear 44 extends from base portion 44 as seen in FIG. 1 and has an opening formed therein. Ear 44 serves as a ground terminal. Base portion 24 also has various other openings formed therein as also seen in FIG. 1. Mounting plate 12 includes a flat leg portion 46 extending transversely from upper end 26 of base portion 24. An elongated U-shaped notch 48 extends into the outer end of leg portion 46. An elongated U-shaped notch 50 extends into side edge 52 of leg portion 46 and an elongated U-shaped notch 54 extends into side edge 56 of leg portion 46. The outer end of leg portion 46 is provided with tapered surfaces or chamfers 58 and 60 located on opposite sides of notch 48. A pair of openings 62 and 64 are formed in leg portion 46 adjacent side edge 56. An opening 65 is formed in leg portion 46 adjacent the inner end of side edge 52.

Mounting plate 12 also includes a flat leg portion 66 extending transversely from lower end 28 of base portion 24. An elongated U-shaped notch 68 extends into the outer end of leg portion 66. An elongated U-shaped notch 70 extends into side edge 72 of leg portion 66 and elongated U-shaped notch 74 extends into side edge 76 of leg portion 66. The outer end of leg portion 66 is provided with tapered surfaces or chamfers 78 and 80 located on opposite sides of notch 68. A pair of openings 82 and 84 are formed in leg portion 66 adjacent side edge 72. An opening 85 is formed in leg portion 66 adjacent side edge 76 at the inner end thereof.

Figure 4:
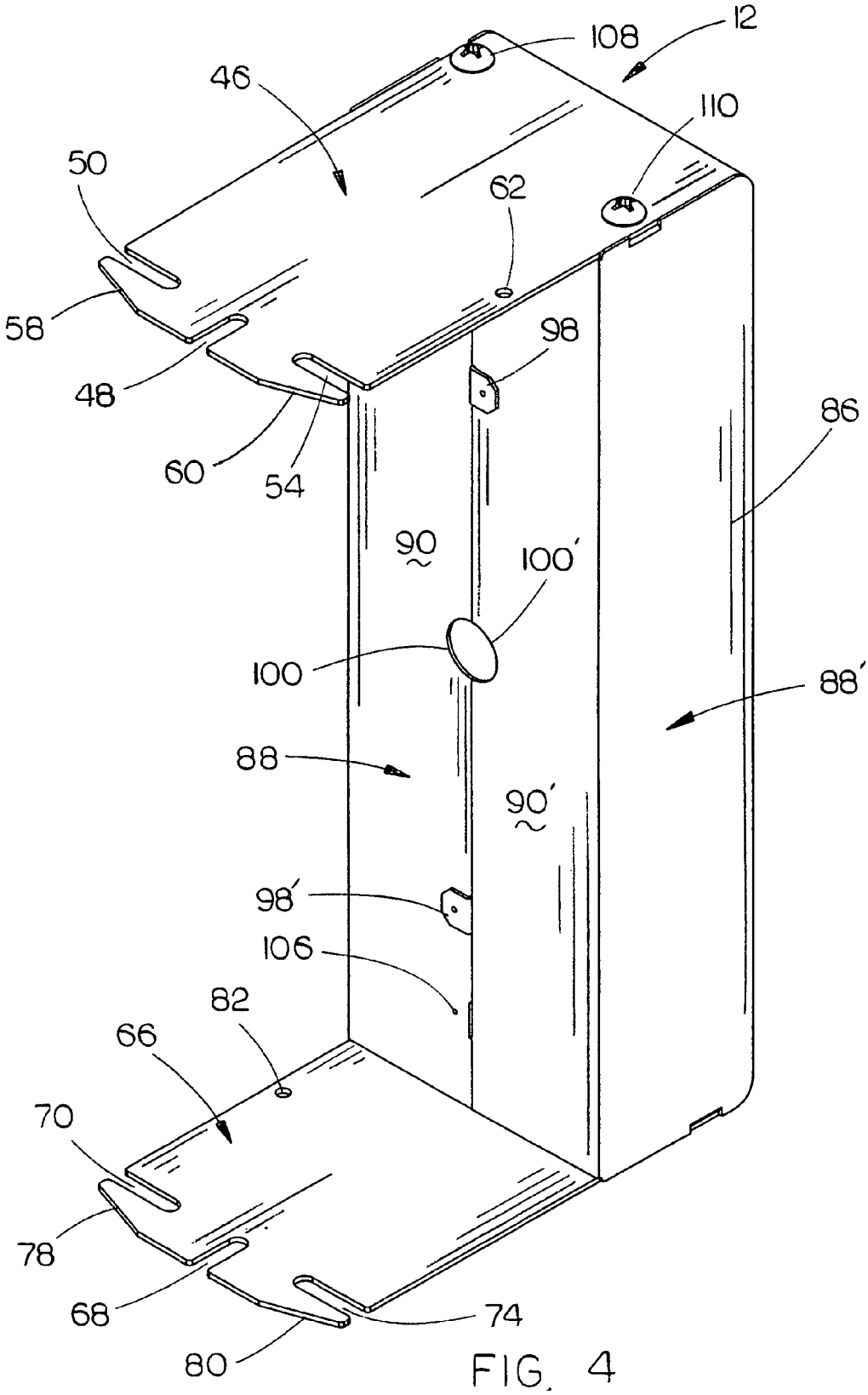
FIG. 4 is a perspective view of the mounting plate of this invention having a junction box cover mounted thereon.
Figure 13:
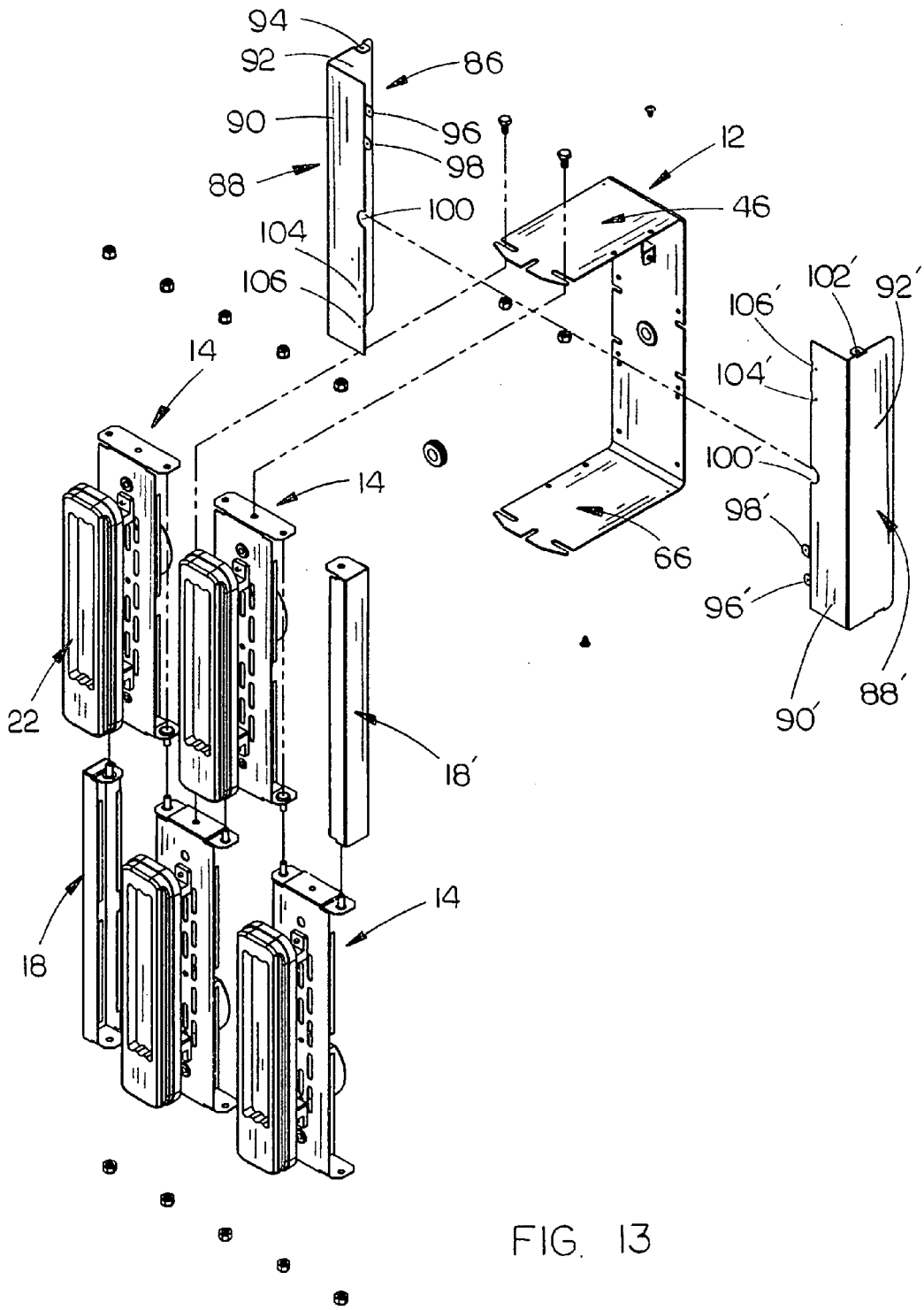
FIG. 13 is an exploded perspective view illustrating four LED module brackets with LED modules thereon to be assembled with the mounting plate.

As seen in FIGS. 4 and 11, junction box cover 16 is comprised of identical L-shaped cover members 88 and 88'. Cover member 88 includes panels 90 and 92 which are transversely disposed with respect to one another. Panel 92 has an ear 94 extending inwardly therefrom. Panel 90 has a pair of spaced-apart ears 96 and 98 extending therefrom as seen in FIG. 13. Ears 96 and 98 are slightly offset with respect to one another for a purpose to be explained hereinafter. Panel 90 has a centrally positioned semi-circular opening 100 formed therein. Cover member 88' includes panels 90' and 92' which are transversely disposed with respect to one another. Panel 92' has an ear 94' extending inwardly therefrom. Panel 90' has a pair of spaced-apart ears 96' and 98' extending therefrom as seen in FIG. 13. Ears 96' and 98' are slightly offset with respect to one another for a purpose to be explained hereinafter. Panel 90' has a centrally positioned semi-circular opening 100' formed therein. In FIG. 13, the cover member 88' is reversed from end to end with respect to cover member 88 so that ears 96' and 98' are positioned lower than ears 96 and 98. One end of panel 92' has an ear 102' extending therefrom. The ear on cover member 88' which corresponds to ear 94 is not visible in FIG. 13. The ear on panel 92 of cover member 88 which corresponds to ear 102' is not visible in FIG. 13. Panel 90 has a pair of openings 104 and 106 formed therein. Those openings in cover member 88' corresponding to openings 104 and 106 are identified as openings 104' and 106' in FIG. 13.

FIG. 13 illustrates the manner in which the junction box 16 cover is assembled and secured to mounting plate 12. Assuming that the cover members 88, 88' and mounting plate 12 are in the position of FIG. 13, cover member 88 is inserted into one side of mounting plate 12 with the ear 94 being received below leg portion 46 so that the opening in ear 94 is in alignment with opening 65 in leg portion 46. A screw 108 is then inserted downwardly through opening 65 and threaded into the opening in ear 94. Cover member 88' is then turned end over end so that cover member 88' is in the position of FIG. 13. The cover member 88' is then inserted into the other side of the mounting plate 12. The ears 96 and 98 are slightly offset from one another as are ears 96' and 98' as previously stated. As previously stated, ear 98' will be positioned outwardly of panel 90 and ear 96' will be positioned inwardly of panel 90. Ear 98 will be positioned outwardly of panel 90' and ear 96 will be positioned inwardly of panel 90'. The ear 102' will be positioned below leg portion 46. A screw 110 is then extended downwardly through opening 64 in leg portion 46 and into the opening in ear 102'. A screw is then inserted into the opening of ear 98' and received by the opening 104 in panel 90. A screw is also extended into the opening 106 and received by the opening in ear 96'. A screw is inserted into the opening in ear 98 and received by opening 104' in panel 90'. A screw is also extended through opening 106' and received by the opening in ear 96. A screw is extended upwardly through opening 85 in leg portion 66 which is received by the opening in the ear 94' of panel 88' corresponding to ear 94 or panel 90. A screw is also extended upwardly through opening 84 in leg portion 66 and received by the opening in the ear of panel 92 which corresponds to ear 102'. At that time the semi-circular openings 100 and 100' will form a circular opening which is aligned with opening 40. The junction box which is housed within cover means 86 will obviously be positioned on the inner surface of base portion 24 of mounting plate 12 prior to the assembly of cover members 88 and 88'. In some situations, a junction box will not be needed and the junction box cover 16 will not be mounted on the mounting plate.

LED module bracket 14 includes a generally rectangular base portion 112 including ends 114 and 116, and side edges 118 and 120. A pair of elongated, generally flat wall members 122 and 124 extend inwardly in a spaced-apart manner from side edge 118 of base portion 112 of module bracket 14. A pair of elongated, generally flat wall members 126 and 128 extend inwardly in a spaced-apart manner from side edge 120 of base portion 112 of module bracket 14. For purposes of description, base portion 112 will be described as having an outer side 130 and an inner side 132. Base portion 112 is provided with a plurality of air flow openings in the form of elongated slots 134 formed therein. The slots 134 serve the function of cooling openings and also reduce dust settlement.

Figure 5:
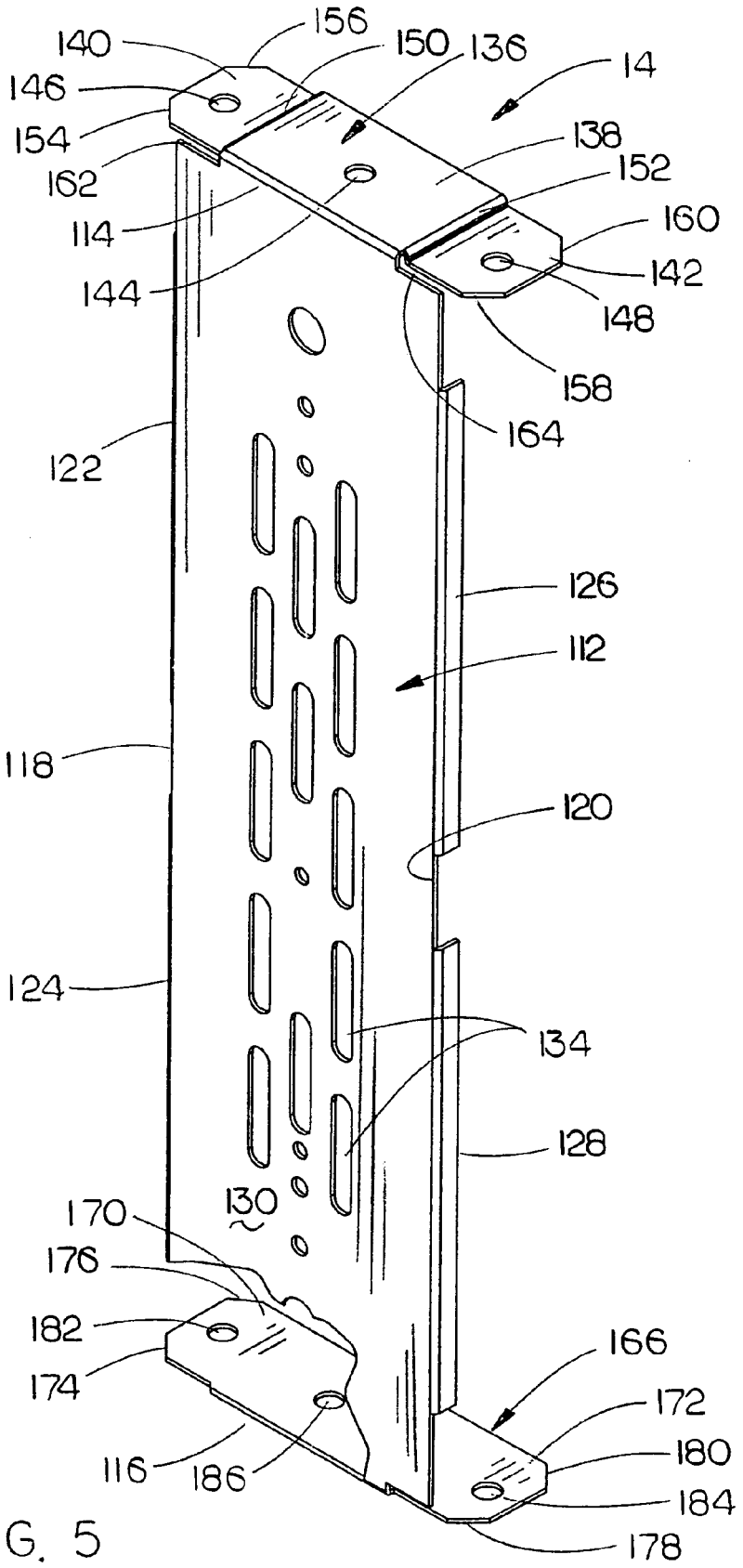
FIG. 5 is a perspective view of the LED module bracket portion of this invention.
Figure 6:
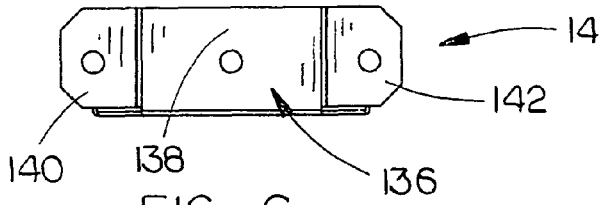
FIG. 6 is a top view of the LED module bracket of FIG. 5.
Figure 9:
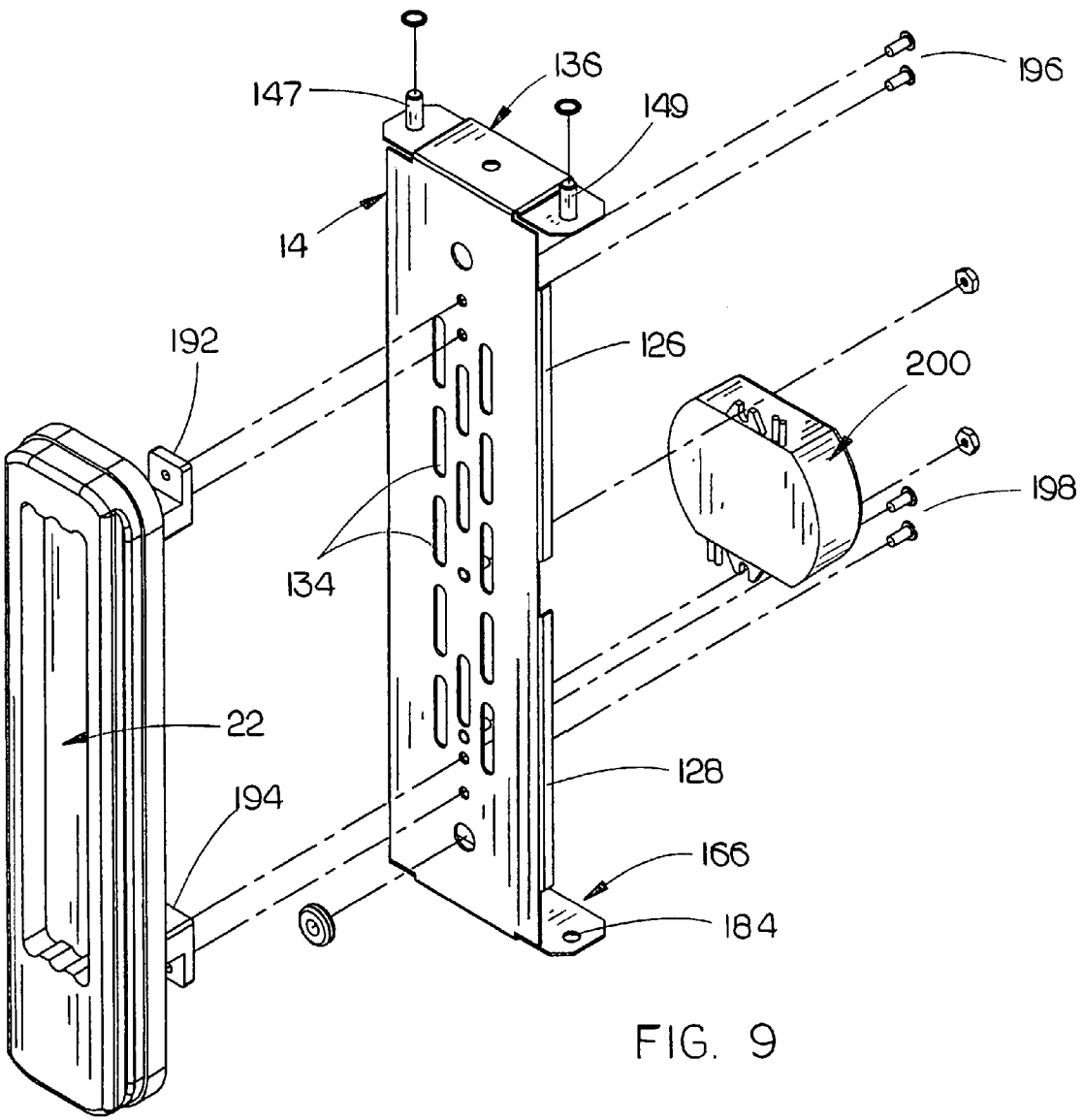
FIG. 9 is an exploded perspective view illustrating the LED module, LED module bracket and power supply of this invention.
Figure 10:
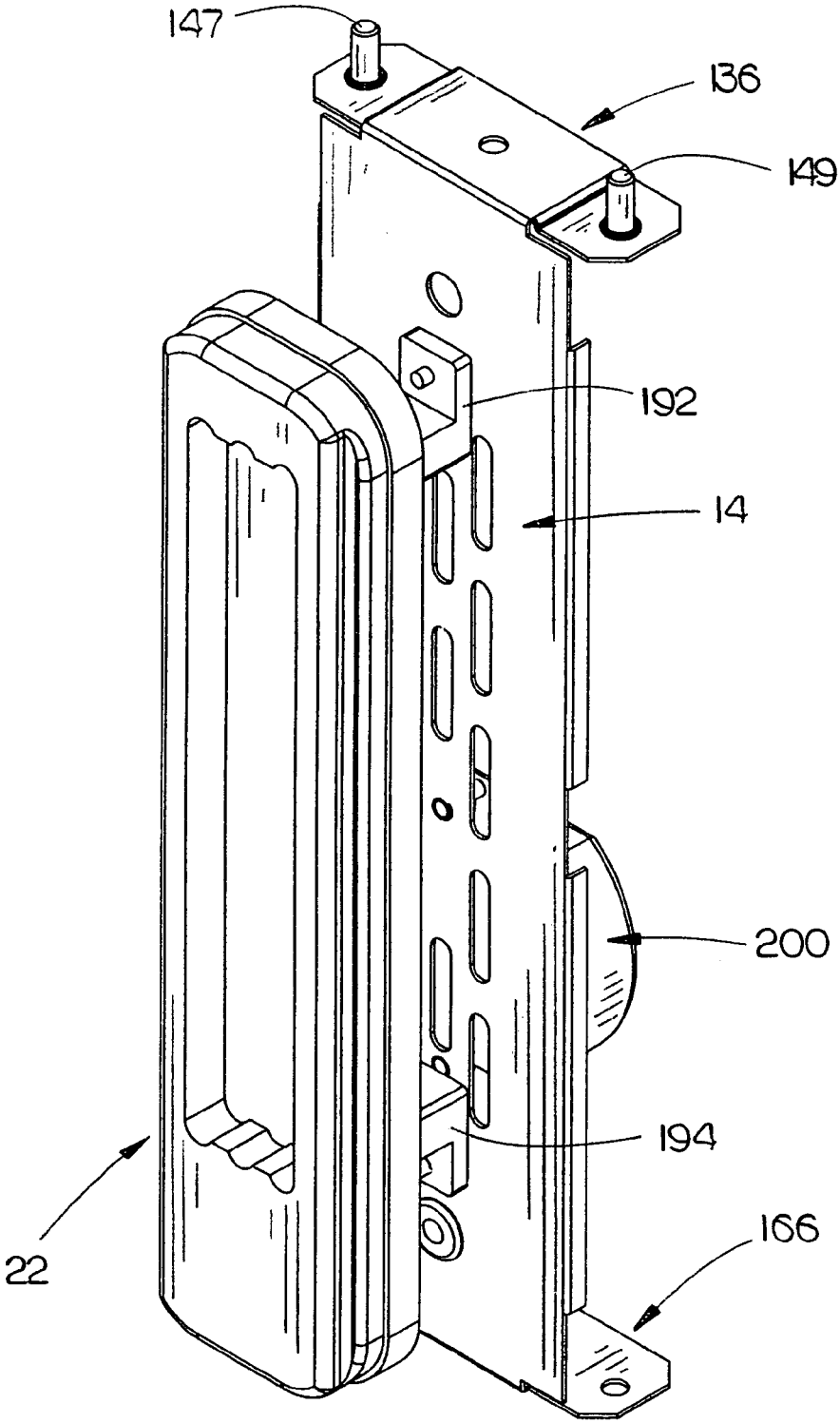
FIG. 10 is a perspective view illustrating the LED module mounted on the LED module bracket.

The numeral 136 refers to a flange which extends inwardly from end 114 of base portion 112 in a transverse manner. Flange 136 includes a central portion 138 and wings 140 and 142 which extend outwardly from the opposite ends of central portion 136. As seen in FIG. 5, the free ends of wings 140 and 142 protrude outwardly of side edges 118 and 120 respectively. In other words, flange 136 has a length which is greater than the width of base portion 112. Central portion 138 has a central opening 144 formed therein while wings 140 and 142 have openings 146 and 148 formed therein respectively. A pair of externally threaded studs 147 and 149 are positioned in openings 146 and 148 respectively and are welded to flange 136 so as to extend outwardly therefrom as viewed in FIGS. 9 and 10. As best seen in FIG. 5, wings 140 and 142 dwell in a different plan than central portion 138 to create a shoulder 150 between wing 140 and central portion 138 and a shoulder 152 between central portion 138 and wing 142. the free end of wing 140 has a pair of spaced-apart tapered portions or chamfers 154 and 156 formed therein. The free end of wing 142 has a pair of spaced-apart tapered portions or chamfers 158 and 160 formed therein. As seen in FIG. 5, a slot 162 is formed between wing 140 and base portion 112 at end 114 and a slot 164 is formed between wing 142 and base portion 112 and end 114.

Figure 7:
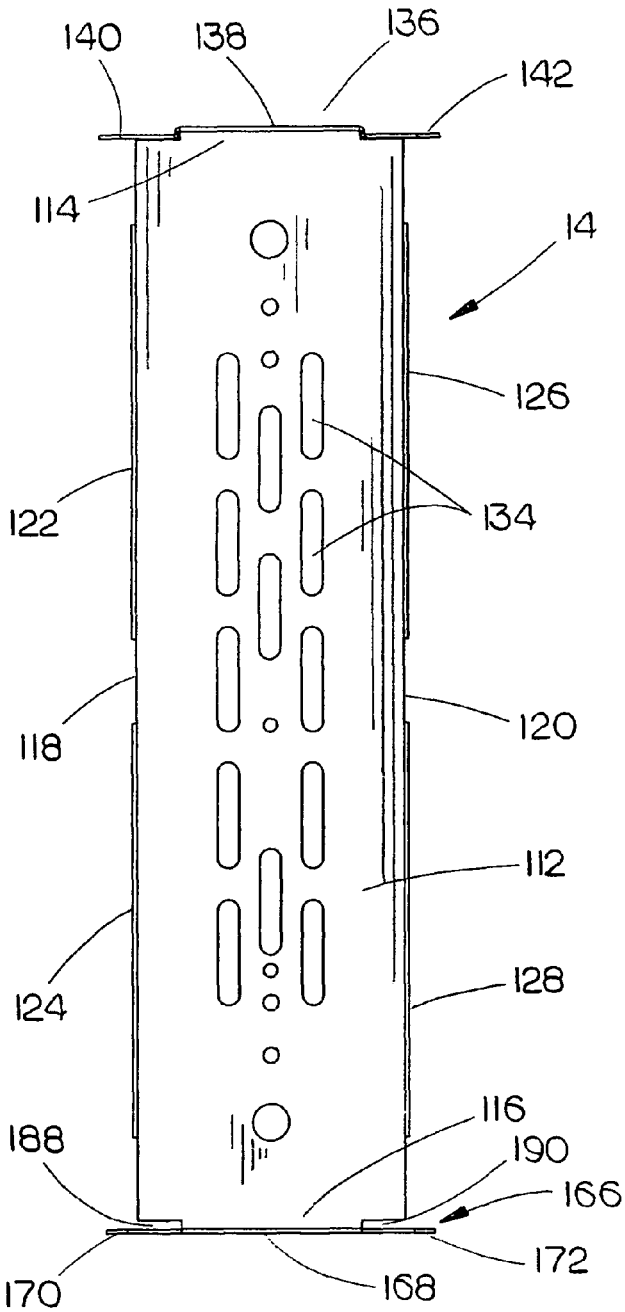
FIG. 7 is a front view of the LED module bracket of FIG. 5.
Figure 8:
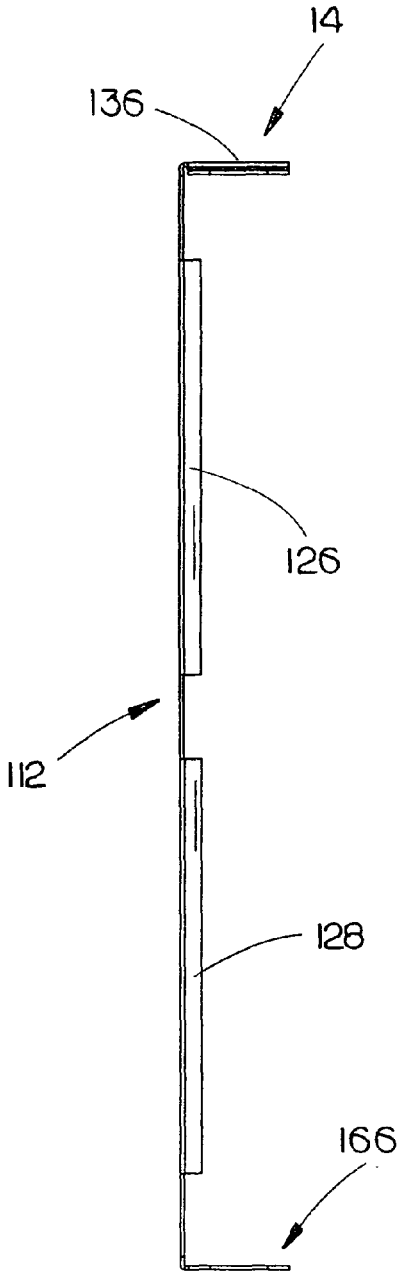
FIG. 8 is a side view of the LED module bracket of FIG. 5.

Modular bracket 14 also includes a flat flange 166 which extends transversely inwardly from end 116 of base portion 112. As seen in FIG. 7, flange 166 includes a central portion 168 and wings 170 and 172 at the opposite ends thereof. As seen, the ends of wings 170 and 172 protrude outwardly of the side edges 118 and 120 of base portion 112 respectively. Wings 170 and 172 dwell in the same plane as central portion 168 and have spaced-apart tapered portions or chamfers 174, 176 and 178, 180 formed in the free ends thereof respectively. Wings 170 and 172 have openings 182 and 184 formed therein. Flange 166 has a central opening 186 formed therein. A slot 188 is formed between wing 170 and base portion 112 at side edge 118. A slot 190 is formed between wing 172 and base portion 112 at side edge 120.

Module 22 includes a pair of spaced-apart stand-offs 192 and 194 which extend inwardly towards module bracket 14 with the stand-offs 192 and 194 being secured to module bracket 14 by a pair of screws or bolts 196 and by a pair of screws 198. A power supply 200 is secured to the inner surface of module bracket 14 by any convenient means.

Figure 12:
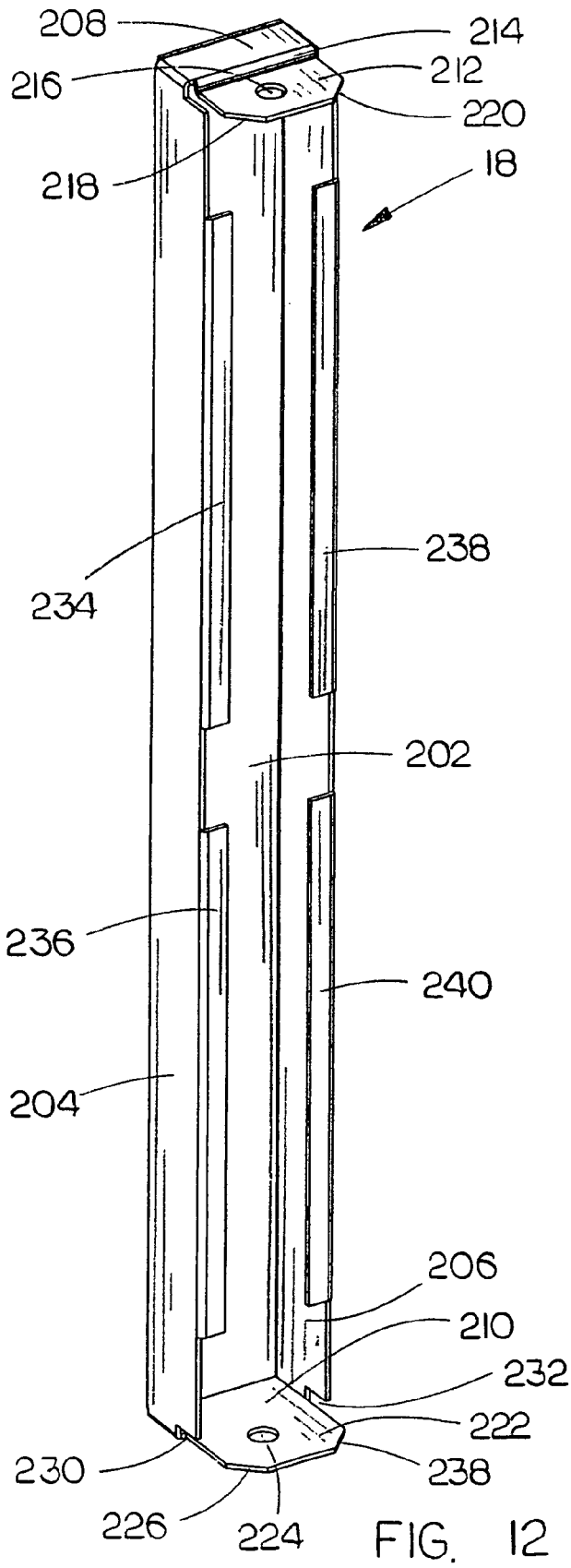
FIG. 12 is a perspective view of the end cap portion of the invention.

The end caps 18 are identical. End cap 18 is generally C-shaped in cross-section and includes a base wall 202, side walls 204, 206, an end wall 208 and an end wall 210. Wing 212 extends from wall 208 as seen in FIG. 12 with a shoulder 214 being positioned therebetween so that wing 212 dwells in a different plane than end wall 208. Wing 212 has an opening 216 formed therein. The free end of wing 212 has tapered portions or chamfers 218 and 220 formed therein. Wing 222 extends from second wall 210 and has an opening 224 formed therein. The free end of wing 222 has tapered portions or chamfers 226 and 228 formed therein. Slots 230 and 232 are provided between wing 222 and walls 204, 206 as seen in FIG. 12. Similar slots are also provided between wing 212 and walls 204 and 206. A pair of wall members 234 and 236 extend transversely from wall 204 and a pair of wall members 238 and 240 extend transversely from wall 206.

When a single LED module is being used in the bay light 10, the assembly is comprised of six parts or components of which two parts are identical, namely mounting plate 12, LED module bracket 14, junction box cover 16, LED module 22 and a pair of end caps 18. In the single LED module configuration, the light 10 is assembled as follows. Normally, the junction box cover 16 will have been previously secured to mounting plate with the junction box being positioned therein. Electrical leads will have been extended into the junction box cover 16 by way of the opening 34 in base portion 24 of mounting plate 12. Leads from the junction box within junction box cover 16 will be extended outwardly through the opening created by semi-circular openings 100 and 100" for eventual connection to the power supply 200. The power supply 200, if not previously secured to LED module bracket 14 by the screws 198 will be secured thereto. The outgoing leads from power supply 200 will be extended outwardly through the lowermost opening in base portion 112 of LED module bracket 14.

The end caps 18 are then secured to the LED bracket module by extending the studs 147 and 149 upwardly through the openings 224 of wing 222. The Led module bracket 14 with the end caps 18 mounted thereon is then positioned between the leg portions 46 and 66 of mounting plate 12 with the studs 147 and 148 being received by the openings 50 and 54 of leg portion 46. Nuts are then secured to the studs 147 and 149. A bolt will then be extended upwardly through opening 70 in leg portion 66, through the opening 216 in wing 212 and through the opening 182 in wing 170 of flange 166 of Led module bracket 14. A bolt will also be extended upwardly through opening 74 in leg portion 66, through the opening 184 of wing 172 of flange 166 of Led module bracket 14. Nuts will then be secured to those bolts. A bolt 242 will then be extended downwardly through opening 48 in leg portion 46 and through opening 144 in flange 136 of LED module bracket 14 with a nut being secured to the lower end of the nut. A similar bolt will also be extended upwardly through opening 68 in leg portion 66 of LED module bracket 14 and through opening 186 in flange 166 of Led module bracket 14 with a nut being threaded onto the upper end of the bolt. Led module 22, if not previously mounted on LED module bracket 14, will then be installed thereon.

When the light 10 has been assembled as seen in FIG. 11, the wall members 122 and 124 will be in close engagement with end cap 18 positioned thereby to prevent the end cap 18 from pivoting or rotating with respect to the LED module bracket 14. The wall members 126 and 128 perform the same function with respect to the end cap 18 positioned thereby.

Figure 14:
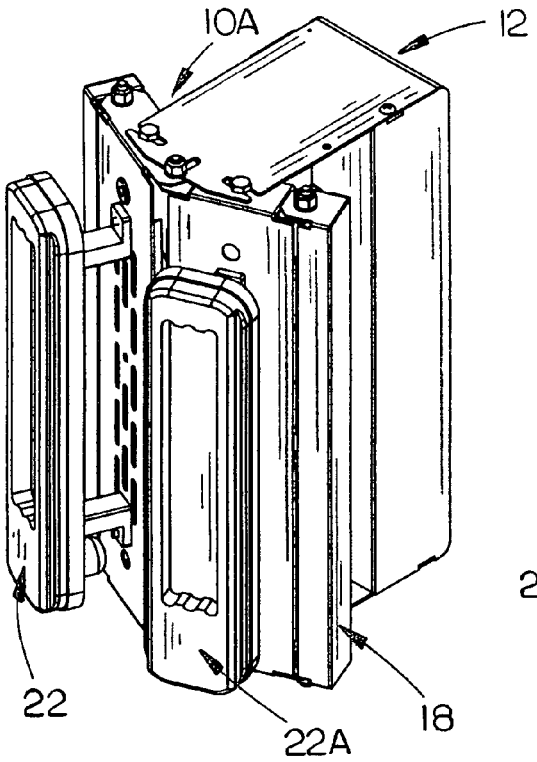
FIG. 14 is a perspective view illustrating the invention with two LED module brackets with LED modules thereon.

If the light 10 is going to utilize two LED modules 22 and 24, the two LED module brackets may be positioned in a side-by-side relationship (FIG. 19 (or in the angular relationship of FIG. 24. In the position of FIGS. 14 and 24, the left hand LED module bracket 14 will be inverted so that flange 168 is uppermost and so that the right hand LED module bracket 14 will have its flange 136 uppermost. In the position of FIGS. 14 and 24, one of the chamfers on the wing 116 will engage the shoulder 150 of flange 136 of the adjacent LED module bracket 14 to limit the pivotal movement of LED module 22 with respect to LED module 22A. One of the chamfers of the flange 166 will engage one of the shoulders of the flange 136 of the adjacent module to assist in limiting the pivotal movement of the LED modules.

If three LED modules are utilized, the components will be positioned as seen in FIG. 20 or FIG. 25.

If four LED modules are utilized, the components will be positioned as seen in FIG. 23 or FIG. 21 or FIG. 22 or FIG. 23.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. In combination;

a mounting plate including a generally flat base portion having first and second ends and first and second side edges, a first generally flat leg portion extending transversely from said first end of said base portion and having a first side edge, a second side edge, an inner end, and an outer end edge, and a second generally flat leg portion extending transversely from said second end of said base portion and having a first side edge, a second side edge, an inner end and an outer end edge;

said base portion of said mounting plate adapted for attachment to either a vertically disposed support or a horizontally disposed support;

a generally rectangular first LED module bracket including a generally rectangular flat base portion having an outer side, an inner side, a first end, a second end, a first side edge and a second side edge, a first flange extending transversely inwardly from said first end of said base portion thereof which has first and second ends, and a second flange extending transversely inwardly from said second end of said base portion thereof which has first and second ends;

each of said first and second flanges having a central portion and first and second wings extending therefrom;

the distance between the ends of each of said flanges being greater than the width of said base portion of said first LED module bracket;

said first flange of said LED module bracket being secured to said first leg portion of said mounting plate adjacent said outer end edge thereof;

said second flange of said LED module bracket being secured to said second leg portion of said mounting plate adjacent said outer end edge thereof; and a generally rectangular first LED module positioned at said outer side of said base portion of said LED module bracket and secured thereto;

a second generally rectangular LED module bracket secured to said mounting plate at one side of said first LED module bracket, said second LED module bracket having a generally rectangular flat base portion having an outer side, an inner side, a first end, a second end, a first side edge, a second side edge, a first flange extending transversely inwardly from said first end of said base portion thereof which has first and second ends, and a second flange extending transversely inwardly from said second end of said base portion thereof which has first and second ends, the distance between the ends of each of said flanges being greater than the width of said base portion of said mounting plate; and a generally rectangular second LED module positioned at said outer side of said base portion of said second LED module bracket, said first flange of said second LED module bracket being secured to said first leg portion of said mounting plate adjacent said outer end edge thereof, said second flange of said second LED module bracket being secured to said second leg portion of said mounting plate adjacent said outer end edge thereof.

2. The combination of claim 1 wherein said first and second LED module brackets have a plurality of spaced-apart cooling slots formed therein.

3. The combination of claim 1 wherein said mounting plate includes a junction box cover means positioned outwardly of said base portion thereof between said first and second leg portions thereof.

4. The combination of claim 3 wherein said junction box cover means is comprised of a pair of junction box cover members secured to said mounting plate.

5. The combination of claim 1 wherein said base portions of said first and second module brackets are parallel to one another.

6. The combination of claim 1 wherein said first and second LED module brackets are selectively pivotally secured to said mounting plate so that the base portions of said first and second LED module brackets may be angularly disposed with one another.

7. The combination of claim 6 wherein said first flange of said first LED module bracket is pivotally secured to said second flange of said second LED module bracket and wherein said second flange of said first LED module bracket is pivotally secured to said first flange of said second LED module.

8. The combination of claim 7 wherein said first flanges of each of said first and second LED modules have a central portion which dwells in a plane different than the ends thereof and wherein each of the ends of said first flanges have chamfers therein for limiting the pivotal movement of said first and second LED modules with respect to one another.

9. The combination of claim 1 wherein a third LED module brackets, which is identical to said first LED module bracket, is secured to said mounting plate with said second LED module bracket being positioned adjacent said first side edge of said first LED module bracket and with said third LED module bracket being positioned adjacent said second side edge of said first LED module brackets, said third module bracket having a third LED module mounted thereon.

10. The combination of claim 9 wherein said second and third LED module brackets are selectively pivotally secured to said mounting plate.

11. In combination;

a mounting plate including a generally flat base portion having first and second ends and first and second side edges, a first generally flat leg portion extending transversely from said first end of said base portion and having a first side edge, a second side edge, an inner end, and an outer end edge, and a second generally flat leg portion extending transversely from said second end of said base portion and having a first side edge, a second side edge, an inner end and an outer end edge;

said base portion of said mounting plate adapted for attachment to either a vertically disposed support or a horizontally disposed support;

a generally rectangular first LED module bracket including a generally rectangular flat base portion having an outer side, an inner side, a first end, a second end, a first side edge and a second side edge, a first flange extending transversely inwardly from said first end of said base portion thereof which has first and second ends, and a second flange extending transversely inwardly from said second end of said base portion thereof which has first and second ends;

each of said first and second flanges of said first LED module bracket having a central portion and first and second wings extending therefrom;

the distance between the ends of each of said first and second flanges being greater than the width of said base portion of said first LED module bracket;

a generally rectangular first LED module positioned at said outer side of said base portion of said first LED module bracket and secured thereto;

said central portion of said second flange of said first LED module bracket being secured to said first leg portion of said mounting plate adjacent said first side edge adjacent to said outer end edge of said first leg portion;

said central portion of first flange of said first LED module bracket being secured to said second leg portion of said mounting plate adjacent said first side edge adjacent to said outer end edge of said second leg portion;

a generally rectangular second LED module bracket, which is identical to said first. LED module bracket, including a generally rectangular flat base portion having an outer side, an inner side, a first end, a second end, a first side edge and a second side edge, a first flange extending transversely inwardly from said first end of said base portion thereof which has first and second ends, and a second flange extending transversely inwardly from said second end of said base portion thereof which has first and second ends;

each of said first and second flanges of said second LED module bracket having a central portion and first and second wings extending therefrom;

the distance between the ends of each of said first and second flanges being greater than the width of said base portion of said second LED module bracket;

a generally rectangular second LED module positioned at said outer side of said base portion of said second LED module bracket and secured thereto;

said central portion of first flange of said second LED module bracket being secured to said first leg portion of said mounting plate adjacent said second side edge adjacent to said outer end edge of said first leg portion;

said central portion of said first flange of said second LED module bracket being secured to said second leg portion of said mounting plate adjacent said second side edge adjacent to said outer end edge of said second leg portion;

said first wing of said second flange of said first LED module bracket being secured to said first wing of said second flange of said second LED module bracket;

said first wing of said second flange of said first LED module bracket being secured to said first wing of said first flange of said second LED module bracket.

12. The combination of claim 11 wherein said second flange of said first LED module bracket is pivotally secured to said first flange of said second LED module bracket and wherein said first flange of said first LED module bracket is pivotally secured to said second flange of said second LED module bracket and wherein second flange of said first LED module bracket and said first flange of said second LED module bracket are pivotally secured to said first leg portion of said mounting plate and wherein said first flange of said first LED module bracket and said second flange of said second LED module bracket are pivotally secured to said second leg portion of said mounting plate.

* * * * *